US012280282B2

(12) United States Patent
Severinac, Sr. et al.

(10) Patent No.: US 12,280,282 B2
(45) Date of Patent: Apr. 22, 2025

(54) HANDS FREE FULL BODY ADJUSTABLE STRAP STRETCHING DEVICE

(71) Applicants: Robert Nicholas Severinac, Sr., Fort Wayne, IN (US); Richard Rutledge, Fort Wayne, IN (US)

(72) Inventors: Robert Nicholas Severinac, Sr., Fort Wayne, IN (US); Richard Rutledge, Fort Wayne, IN (US)

( * ) Notice: Subject to any disclaimer, the term of this patent is extended or adjusted under 35 U.S.C. 154(b) by 227 days.

(21) Appl. No.: 18/147,001

(22) Filed: Dec. 27, 2022

(65) Prior Publication Data

US 2024/0207665 A1 Jun. 27, 2024

(51) Int. Cl.
*A63B 21/00* (2006.01)
*A63B 23/00* (2006.01)

(52) U.S. Cl.
CPC .. *A63B 21/00043* (2013.01); *A63B 21/00069* (2013.01); *A63B 21/4015* (2015.10); *A63B 2023/006* (2013.01)

(58) Field of Classification Search
CPC ..... A63B 21/00043; A63B 21/00069; A63B 21/0442; A63B 21/0552; A63B 21/0555; A63B 21/0557; A63B 21/4015; A63B 2023/006
See application file for complete search history.

(56) References Cited

U.S. PATENT DOCUMENTS

| | | | | |
|---|---|---|---|---|
| 6,840,894 | B2 * | 1/2005 | Lerner | A63B 21/4025 482/121 |
| 7,137,935 | B2 * | 11/2006 | Clarke | A63B 21/1609 482/904 |
| 8,220,073 | B2 * | 7/2012 | Lopez | A41D 13/065 2/24 |
| 8,944,976 | B2 * | 2/2015 | Crowell | A63B 21/00043 482/121 |
| 10,195,475 | B2 * | 2/2019 | Schreiber | A63B 21/00061 |
| 10,532,240 | B2 * | 1/2020 | Thrasher-Rudd | A63B 7/00 |
| 11,311,763 | B2 * | 4/2022 | Yeates | A63B 21/018 |
| 11,701,535 | B2 * | 7/2023 | Holmes | A63B 21/065 482/131 |
| 2011/0130253 | A1 * | 6/2011 | Fuller | A63B 21/169 482/122 |
| 2021/0100707 | A1 * | 4/2021 | Wolpe | A63B 21/4043 |

* cited by examiner

*Primary Examiner* — Megan Anderson
(74) *Attorney, Agent, or Firm* — TAYLOR & EDELSTEIN

(57) ABSTRACT

An exercise stretching device includes a proximal loop component having a strap configured to form a loop, an adjustable clamp configured to couple two opposite ends of the strap to form the loop, and a pad carried by the strap; a distal slotted component having a plurality of slots situated along its length, the strap being disposed in one of the plurality of slots; and a distal grommet component looped around the strap and including at least one integrated grommet.

18 Claims, 8 Drawing Sheets

HANDS FREE FULL BODY ADJUSTABLE STRAP STRETCHING DEVICE

BACKGROUND OF THE INVENTION

The importance of creating and maintaining flexibility is generally recognized in health, longevity, fitness, sports, ballet, and yoga. Stretching requires a sustained and prolonged effort in holding a particular joint in a stretched position for best results. For best user results, stretching devices should be simple to apply, comfortable, easy to adjust, safe and offer a variety of stretches throughout the body, and employ other static or dynamic point of fixation.

Prior art devices have recently been developed harnessing both shoulders to provide hands free stretching, but they fall short in giving a user the most effective stretching experience.

Current hands-free stretching devices require the user to apply and adjust multiple clips such as around the torso, around each shoulder, and at the leg. This can lead to user fatigue, confusion and less active user stretching.

Padding on hands free shoulder based stretching devices is not seen in prior art. This leads to discomfort and less active user stretching.

Adjustment in position and tension is accomplished by more than one strap clasp in prior art hands free stretching devices. This leads to complicated maneuvers for the user leading to less active user stretching.

Strap clamp adjusters appear to be the only method in adjusting stretching tension in current hands-free stretching devices. This can lead to slow and cumbersome adjustments during user stretching.

Strong and safe clamping of strap material is not recognized in prior art. This can lead to user stretching failure or user injury. Current hands-free stretching devices do not have durable fixation points to accommodate attaching to fixed or dynamic objects limiting the stretching utility of these devices.

The current invention addresses all these issues.

BRIEF SUMMARY OF THE INVENTION

The Full Body, Hands-Free, Adjustable Strap Stretching Device has applicability in physical therapy, sports, yoga, ballet, health, and longevity. This device in provides for a variety of hands-free stretching that is easy to apply, comfortable, easy to adjust, safe, powerful, and prolonged. Once the user gets into a position or pose with this current invention, he/she can relax and allow strap tension, position, static and or dynamic forces do the work of stretching throughout virtually all areas of the body.

This current invention solves the problems of prior art devices by providing:

- A hands-free stretching device with strong and safe clamping of strap mechanism.
- User comfort with padding over strap in the Proximal Loop Component.
- Easy to access and application of the invention on a user with a single clamp strap on the Proximal Component.
- Easy to adjust fine stretch tension with a single clamp in the Proximal Loop Component.
- Easy to adjust coarse levels of tension with foot placement in the Distal Slotted Component.
- Fixation to stationary object with the Distal Slotted Component leveraging gravity for neck, shoulder, torso, back and lower extremity stretching.

- Fixation to a weight machine or fitness machine with the Distal Grommet Component for dynamic force stretching of the neck, shoulder, torso, back and lower extremity.
- Four levels of stretch tension adjustments including fine clamp adjustment, coarse foot position adjustment, static object fixation gravity adjustment, and dynamic attached machine adjustment.
- Full body stretching opportunities with laying, sitting, standing, and fixation of the current invention to static or dynamic weight machine or fitness machine.

DETAILED DESCRIPTION OF THE INVENTION

Figure 1A:
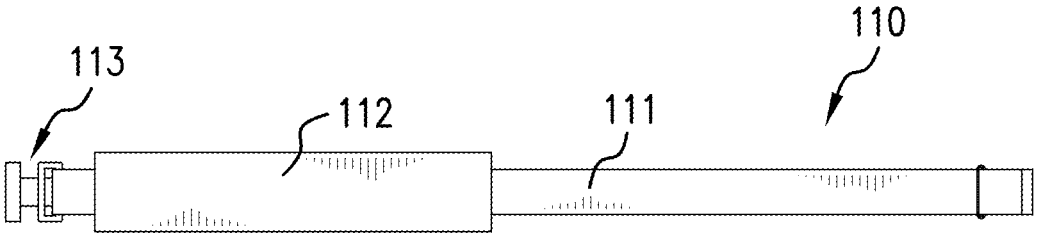
FIG. 1A illustrates a top view of a proximal loop component provided according to the present invention.
Figure 2:
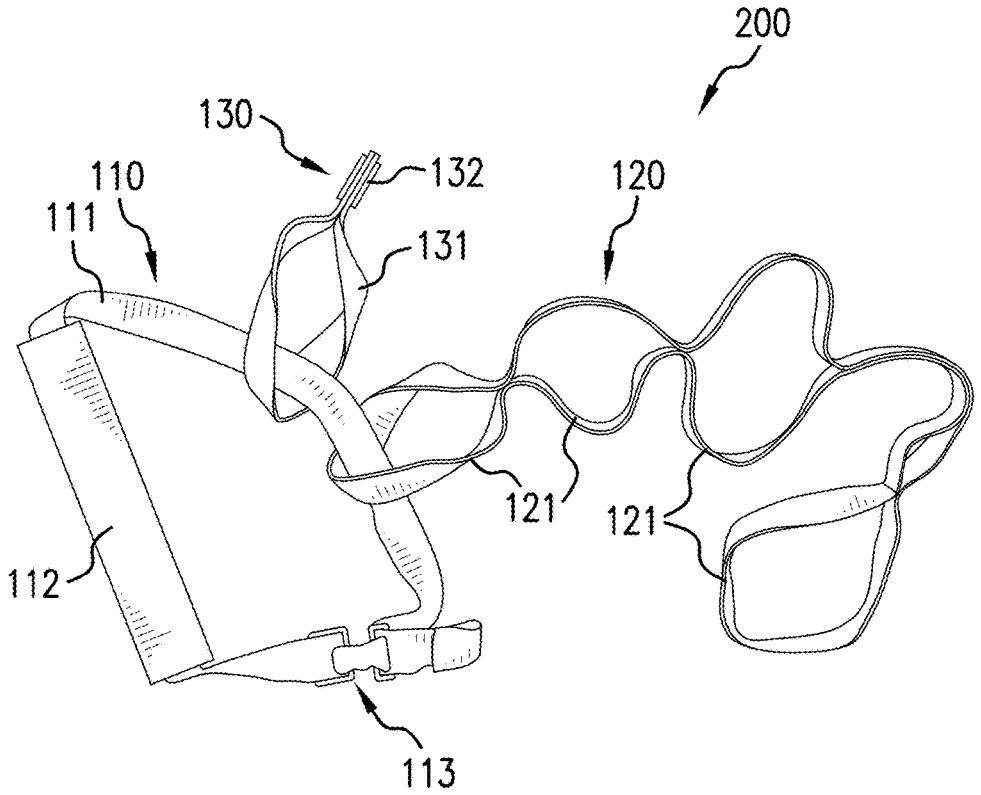
FIG. 2 illustrates an exercise stretching device provided according to the present invention in a natural state and that includes the proximal loop component of FIG. 1A, the distal slotted component of FIGS. 1B and 1C, and the distal grommet component of FIGS. 1D and 1E.

This current invention simplifies application to the body by basing the device 200 on a single heavy cotton strap loop and single clamp known as the Proximal Loop Component 110 (FIGS. 1A, 2). The user takes this component 110, loosens a single clamp 113, applies the device 200 over the shoulder, around the torso, or on a leg and simply tightens the loop with a pull on the strap 111 quickly engaging the clamp to proper fitment.

This current invention incorporates a padded strap 112 in the Proximal Loop Component 110 (FIGS. 1A, 2-3) for user comfort. This can be either fixed to the underlying strap 111 by sewing or left free to glide around the strap 111 for additional comfort adjustment.

The current invention embodies a single alligator spring loaded clamp 113 which is located at one end of the Proximal Loop Component 110 nearest the padding 112 (FIG. 1A). This allows the user to see and access the clamp 113 and adjust the stretching tension while the device 200 is in use on the user. This is considered the fine adjustment of this device 200. An instructor could also easily adjust the strap 111 with the clamp 113 readily visible on the device 200.

Figure 1B:
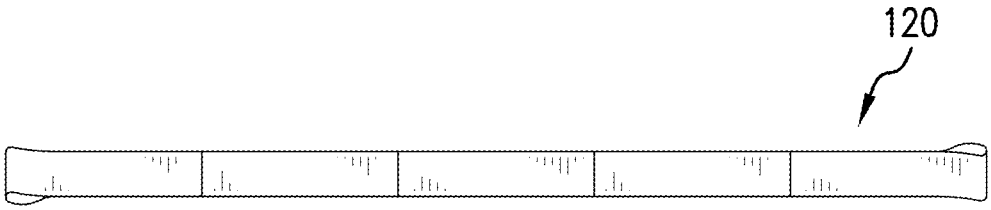
FIG. 1B illustrates a top view of a distal slotted component provided according to the present invention.
Figure 1C:
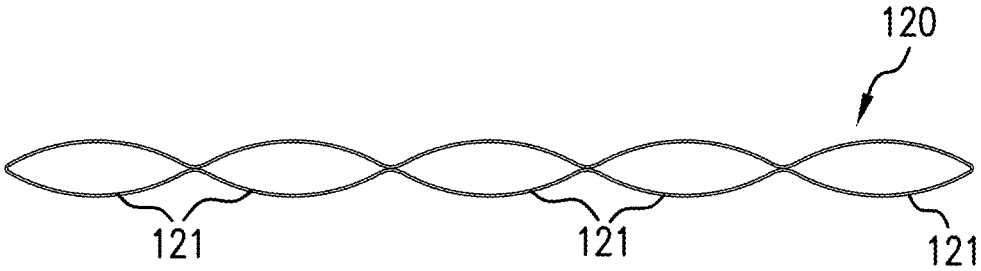
FIG. 1C illustrates a side view of the distal slotted component illustrated in FIG. 1B.

Another method of adjusting tension is by foot placement in the Distal Slotted Component 120 of this device 200 (FIGS. 1B-1C, 2). The location of the user's foot along this component 120 determines the amount of tension applied across the area of interest. It is considered a coarser adjustment allowing the user to get to the next stretch force level quickly. This is typically followed by the finer adjustment with the Proximal Loop Component clamp 113 noted above.

This invention incorporates a strong spring-loaded alligator type clamp 113 in the Proximal Loop Component (FIG. 1A) which supports hundreds of pounds of force when this part of the device 200 is manufactured with proper heavy cotton strap material.

Figure 7:
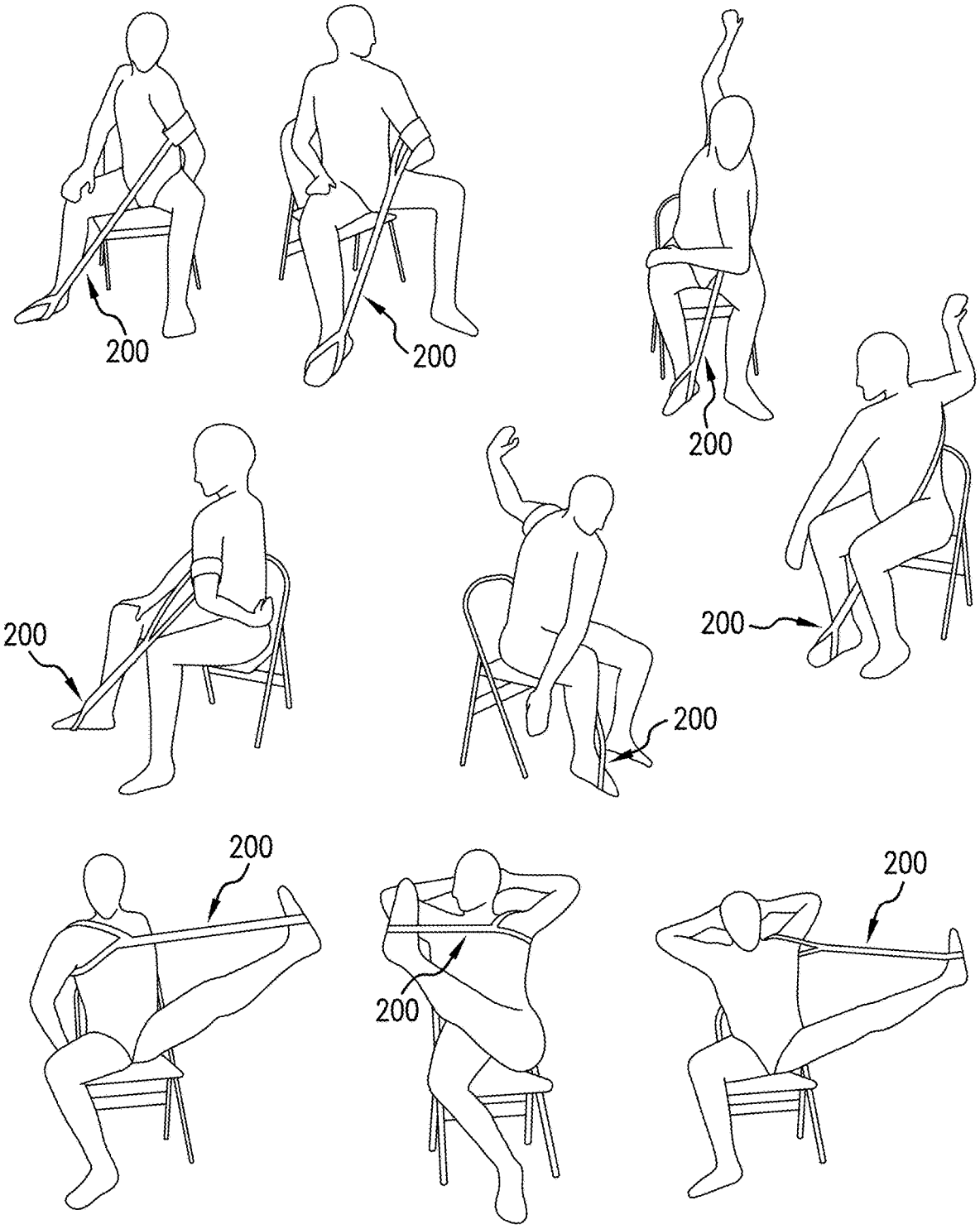
FIG. 7 illustrates a user using the exercise stretching device of FIGS. 2-3 in various positions and poses while seated in a chair.
Figure 8:
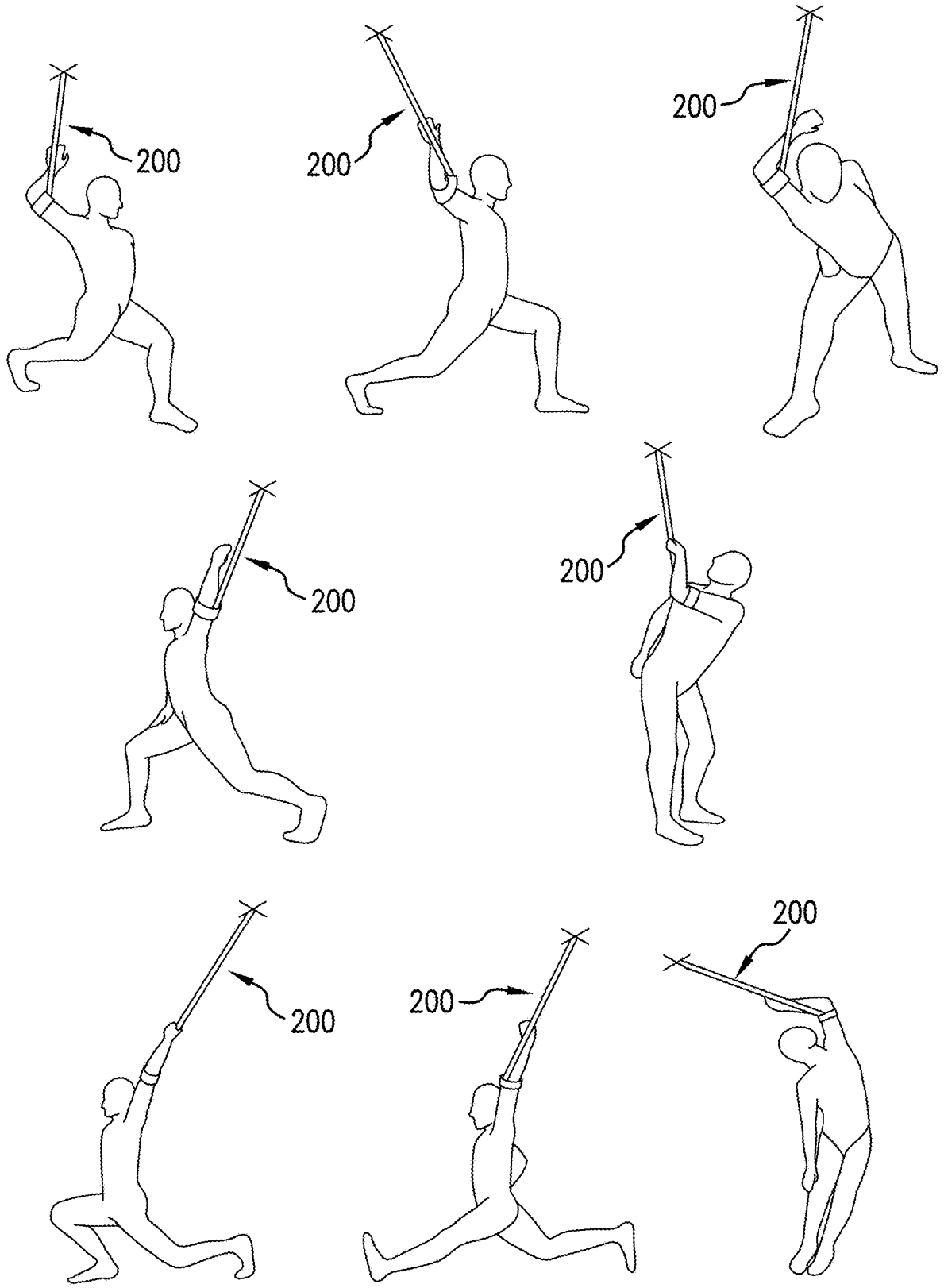
FIG. 8 illustrates a user using the exercise stretching device of FIGS. 2-3 in various positions and poses while the exercise stretching device is coupled to a stationary object.

This invention allows for multiple stretch positions and poses on the floor (FIGS. 5-6), in a chair (FIG. 7), and standing (FIG. 8).

This invention embodies the Distal Slotted Component 120 which includes a plurality of slots 121 in the form of slotted sites that can be looped, for example on a fixed bar (i.e., Pull up bar) or ceiling fixed screw islet (FIG. 8). This leverages gravity and allows for neck, shoulder, torso, back as well as lower extremity stretching.

This invention embodies the Distal Grommet Component 130 (FIGS. 1D-2) which incorporates strap grommets 132 to allow fixation with mountaineer type metal clips commonly found in gyms. This allows for attachment to weight and other fitness machines (represented by an "x" in FIG. 8) to this current invention for dynamic stretching of the neck, shoulders, torso, back, hips, and lower extremities (FIG. 8).

The Hands-Free Full Body Adjustable Strap Stretching Device 200 consists of three components 110, 120, 130 that are connected by looping them together.

The Proximal Loop Component 110 is a long piece of heavy cotton strap 111 with a fixed or "floating" soft pad 112. The latter encompasses the strap 111 and is either fixed to it by sewing or is mobile over it by sewing the pad material to itself along the edges but not into the underlying strap 111. There is a spring-loaded alligator type of clamp 113 fixed at the end of this strap 111 near the fixed soft pad 112. The other end of this component 110 has a sewn folded strap end "hard stop" to prevent the clamp 113 from completely releasing off the end of the strap 111 in the event of failure or excess forces. This section 110 is placed around the user's shoulder, chest, torso, leg, or head and is attached to the Distal Slotted Component 120 and the Distal Grommet Component 130. The pad 112 is for user comfort. The clamp 113 allows the user to fine tune the force of a stretch by tightening or loosening the strap 111 while in a stretching position.

Figure 3:
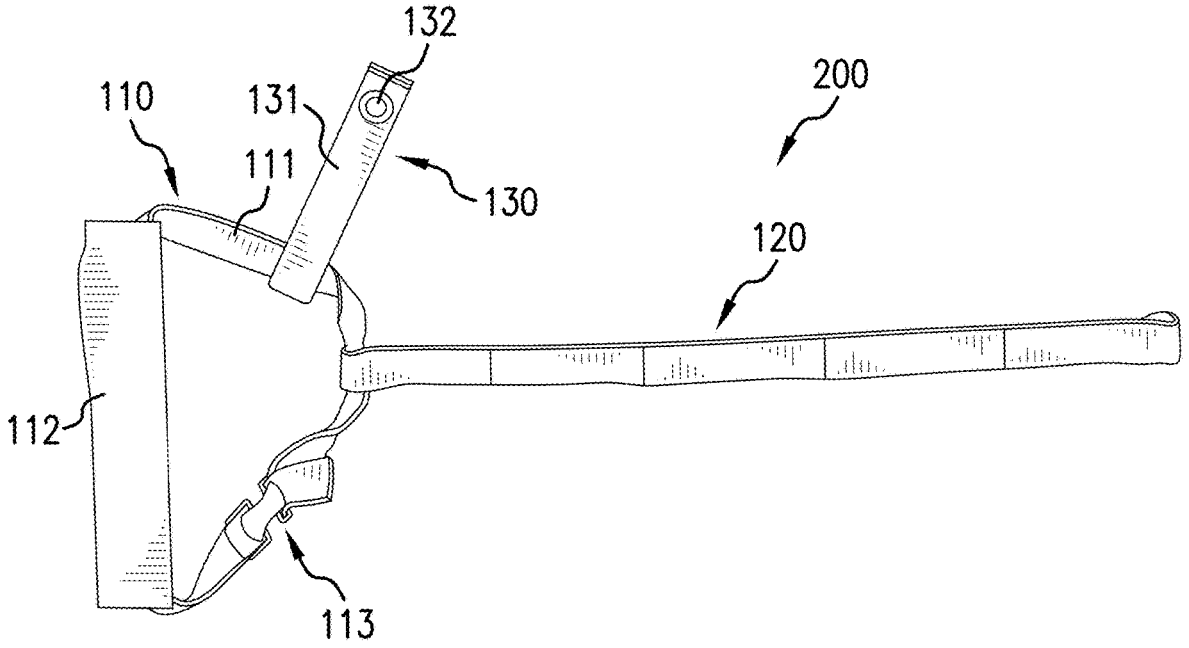
FIG. 3 illustrates the exercise stretching device of FIG. 2 in a straightened state.
Figure 4A:
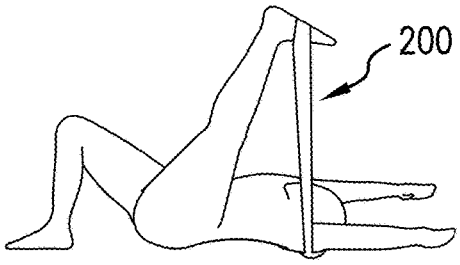
FIG. 4A illustrates the exercise stretching device of FIGS. 2-3 being used by a user to stretch their hamstring on a floor.
Figure 4B:
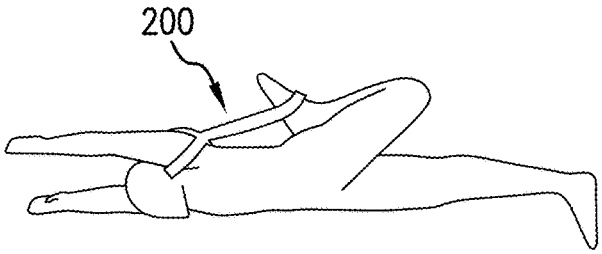
FIG. 4B illustrates the exercise stretching device of FIGS. 2-3 being used by a user to stretch their quadriceps on a floor.
Figure 4C:
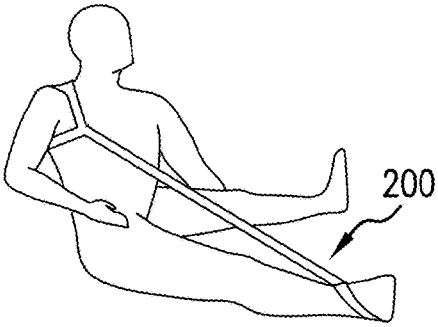
FIG. 4C illustrates the exercise stretching device of FIGS. 2-3 being used by a user to stretch their shoulder, lower back, and hamstring on a floor.
Figure 4D:
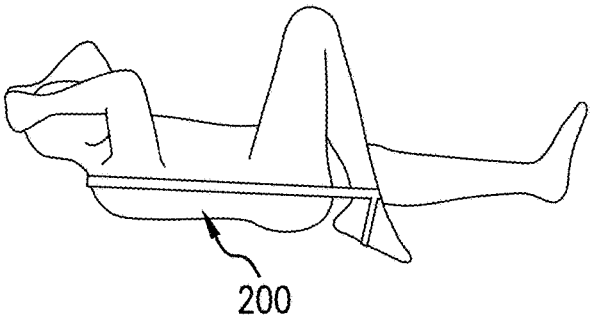
FIG. 4D illustrates the exercise stretching device of FIGS. 2-3 being used by a user to stretch their knee and quadricep on a floor.
Figure 4E:
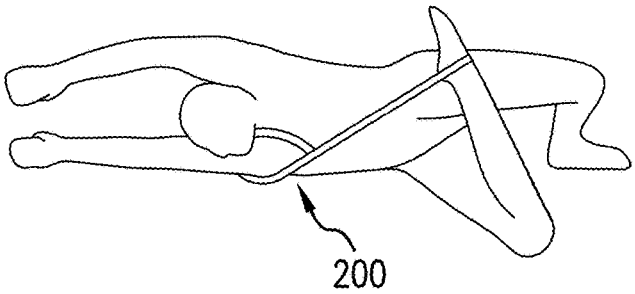
FIG. 4E illustrates the exercise stretching device of FIGS. 2-3 being used by a user to stretch their hip on a floor.

The Distal Slotted Component 120 is made up of a long piece strap material that is folded on itself and sewn together in sections to provide slots 121 for insertion of the foot or fixation to a stationary object. FIG. 1B shows a top view while FIG. 1C shows a side view demonstrating the slots 121 created by sewing the strap together between the slots 121. FIG. 2 demonstrates the Distal Slotted Component 120 attached by looping with the Proximal Loop Component 110 in the device's natural state. FIG. 3 demonstrates the Distal Slotted Component 120 looped to the Proximal Loop Component 110 in a stretched state. With the Proximal Loop Component 110 in place, the user is able to position a foot along the Distal Slotted Component 120 which adjusts the amount of stretching force that will be applied across the area of interest. The user can also place this component on a static structure using one of the slots such as to a pull up bar to leverage gravity in the stretching process (FIG. 8). The stretching force is adjusted by positioning and posing the users body in reference to the fixation point. More fine adjustment is obtained through the clamp 113 and strap 111 on the Proximal Loop Component 110.

Figure 1D:
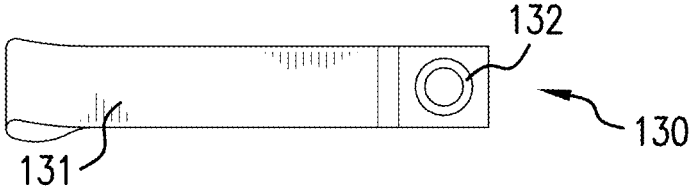
FIG. 1D illustrates a top view of a distal grommet component provided according to the present invention.
Figure 1E:
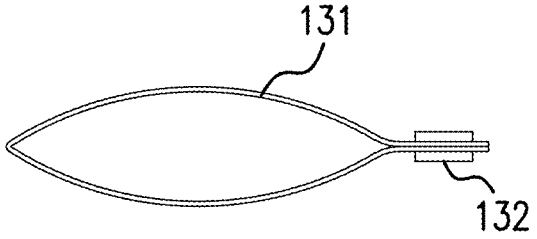
FIG. 1E illustrates a side view of the distal grommet component of FIG. 1D.

The Distal Grommet Component 130 is made up of a piece of strap material 131 that is folded on itself, sewn together, and then pierced with one or more grommets 132. FIG. 1D shows a top view with a grommet 132 at one end while FIG. 1E shows a side view demonstrating the loop available for attachment to the Proximal Loop Component 110. FIG. 2 demonstrates the Distal Grommet Component 130 attached by looping with the Proximal Loop Component 110 in the devices natural state. FIG. 3 demonstrates the Distal Grommet Component 130 looped to the Proximal Loop Component 110 in a stretched state. With the Proximal Loop Component 110 in place, the user can attach this component 130 to a weight machine or fitness machine and use the machines dynamic force to stretch an area. The stretching force is adjusted by the users positioning, the amount of force chosen on the weight or fitness machine the Distal Grommet Component 130 is attached to. More fine adjustment is obtained through the clamp 113 and strap 111 on the Proximal Loop Component 110.

Figure 5:
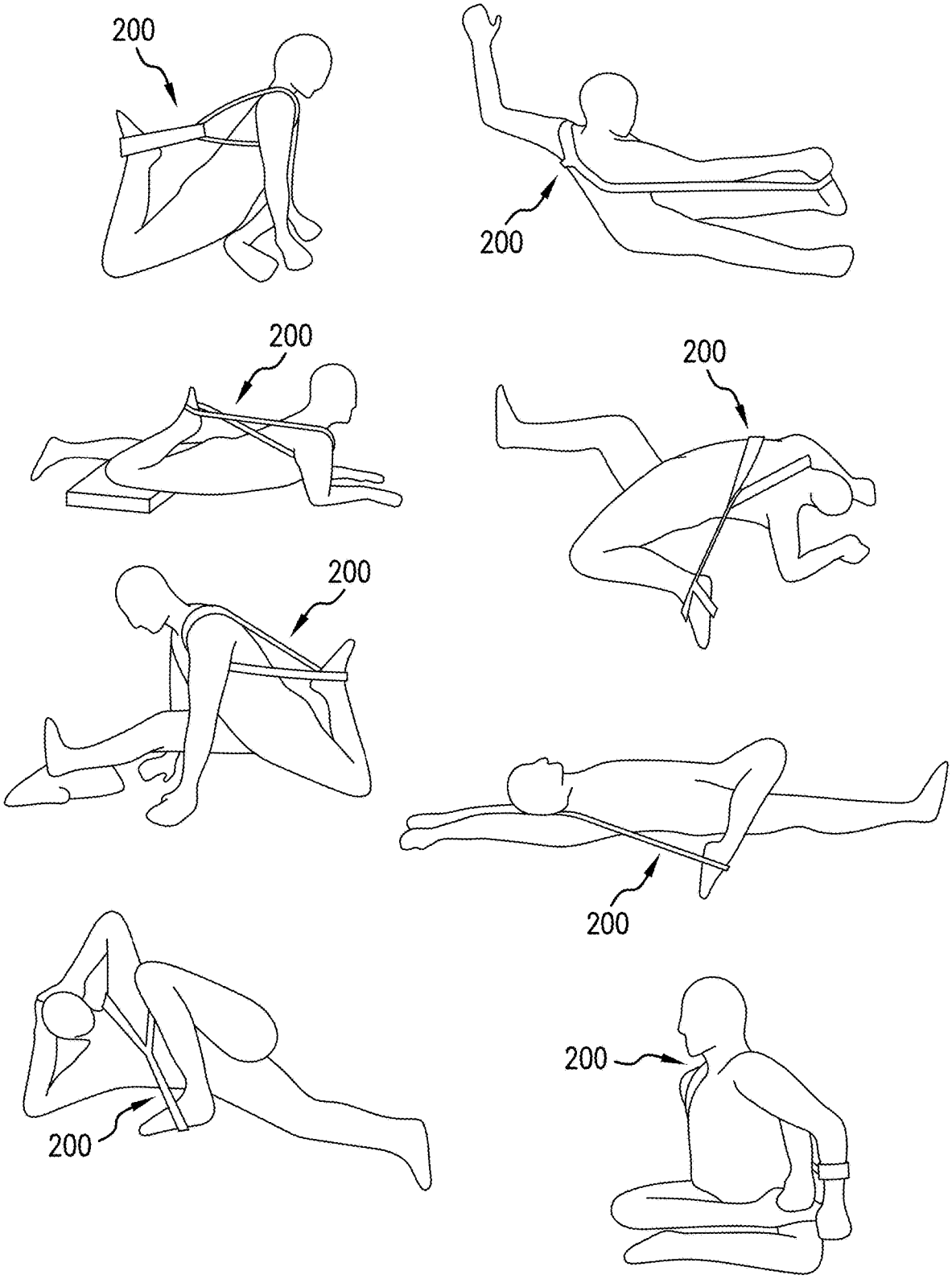
FIG. 5 illustrates a user using the exercise stretching device of FIGS. 2-3 in various positions and poses on a floor.
Figure 6:
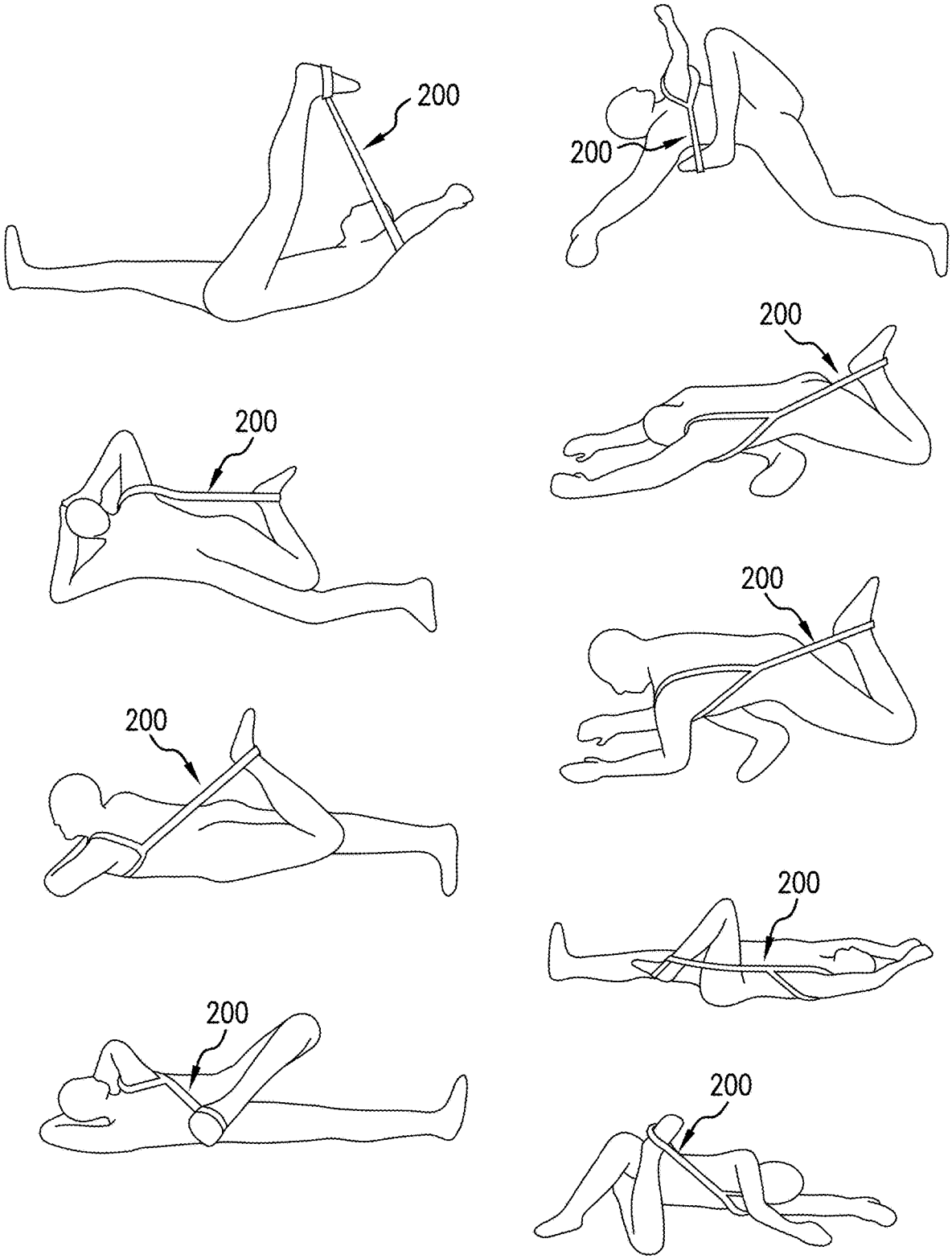
FIG. 6 illustrates a user using the exercise stretching device of FIGS. 2-3 in various additional positions and poses on a floor.

Methods of Use are illustrated in FIGS. 4-8, which are simplified drawings to give clarity in the location of the invention and the human form interplay. FIGS. 4A-4E show basic poses with the device 200. The parallel lines depict the muscles and fascia under stretching tension forces. The grey areas depict the joints "at play" in these stretching positions and poses. FIGS. 5 and 6 depict multiple floor stretch positions and poses. FIG. 7 depicts multiple chair stretch positions and poses. FIG. 8 depicts multiple fixed- and dynamic-point stretch positions and poses. The fixation points are represented by an "x" in the drawings and could be either the Distal Slotted Component 120 fixed static attachment or the Distal Grommet Component 130 for dynamic attachment to a weight or fitness machine.

Once the user gets into a stretching pose, the invention allows for hands free, powerful, prolonged, and adjustable stretching of the body with minimal effort by the user.

The invention claimed is:

1. An exercise stretching device, comprising:

a proximal loop component comprising a strap configured to form a loop, an adjustable clamp configured to couple two opposite ends of the strap to form the loop, and a pad carried by the strap;

a distal slotted component comprising a plurality of slots situated along its length, the strap being disposed in one of the plurality of slots; and a distal grommet component looped around the strap and comprising at least one integrated grommet.

2. The exercise stretching device of claim 1, wherein the distal grommet component comprises a piece of strap material that is folded on itself and pierced with the at least one integrated grommet.

3. The exercise stretching device of claim 2, wherein the piece of strap material is sewn together.

4. The exercise stretching device of claim 1, wherein the clamp is situated at one of the ends of the proximal loop component in such a way that the clamp is accessible for tension adjustment while the exercise stretching device is in use.

5. The exercise stretching device of claim 1, wherein the clamp is a spring-loaded alligator type clamp configured to safely support forces necessary in stretching with the exercise stretching device.

6. The exercise stretching device of claim 1, wherein the distal slotted component is removable from the strap of the proximal loop component when the proximal loop component is in an unlooped state.

7. The exercise stretching device of claim 1, wherein the distal slotted component comprises a strap of material that is folded on itself and sewn together in sections to form the plurality of slots.

8. The exercise stretching device of claim 1, wherein at least one of the slots of the distal slotted component is configured to receive a human foot therein.

9. The exercise stretching device of claim 1, wherein the distal slotted component is configured to secure the exercise stretching device to a stationary object.

10. The exercise stretching device of claim 1, wherein the distal grommet component is configured to attach to an external structure and/or a fitness machine using a clip.

11. A method of using an exercise stretching device, the exercise stretching device comprising a proximal loop component comprising a strap configured to form a loop, an adjustable clamp configured to couple two opposite ends of the strap to form the loop, and a pad carried by the strap; a distal slotted component comprising a plurality of slots situated along its length, the strap being disposed in one of the plurality of slots; and a distal grommet component looped around the strap and comprising at least one integrated grommet, the method comprising:

placing a body part of a user against the pad; and tensioning the distal slotted component and/or the distal grommet component.

12. The method of claim 11, further comprising placing one of the slots or an end of the distal slotted component onto an external structure to couple the distal slotted component to the external structure, wherein the body part is a neck, a shoulder, a torso, a back, or a lower extremity of the user.

13. The method of claim 12, further comprising positioning the user in a plurality of positions and poses while the distal slotted component is coupled to the external structure.

14. The method of claim 11, further comprising attaching the distal grommet component to a weight machine or a fitness device, wherein the body part is a neck, a shoulder, a torso, a back, or a lower extremity of the user.

15. The method of claim 14, further comprising positioning the user in a plurality of positions and poses while the distal grommet component is attached to the weight machine or the fitness device.

16. The method of claim 11, further comprising positioning the user in a plurality of positions and poses on a floor while the body part of the user is placed against the pad.

17. The method of claim 11, further comprising positioning the user in a plurality of positions and poses while sitting in a chair and while the body part of the user is placed against the pad.

18. The method of claim 11, further comprising adjusting the clamp by another user while the body part of the user is placed against the pad.

* * * * *